United States Patent [19]

Chau et al.

[11] Patent Number: 4,881,083

[45] Date of Patent: Nov. 14, 1989

[54] HOMING TECHNIQUE FOR AN IN-GROUND BORING DEVICE

[75] Inventors: Albert W. Chau, Redmond; John E. Mercer, Kent, both of Wash.

[73] Assignee: FlowMole Corporation, Kent, Wash.

[21] Appl. No.: 914,706

[22] Filed: Oct. 2, 1986

[51] Int. Cl.[4] ..... E21B 44/00; E21B 47/022

[52] U.S. Cl. ..... 342/459; 175/26; 175/45; 324/346; 340/855; 343/719

[58] Field of Search ..... 343/742, 719, 853, 893, 343/867; 324/345, 346; 455/40; 342/22, 459; 175/45, 62, 24, 26; 340/854, 855

[56] References Cited

U.S. PATENT DOCUMENTS

| | | | |
|---|---|---|---|
| 2,291,450 | 7/1942 | Case | 343/867 |
| 2,908,863 | 10/1959 | Neff | 343/841 |
| 3,589,454 | 6/1971 | Coyne | 175/45 |
| 3,731,752 | 5/1973 | Schad | 175/45 |
| 3,900,878 | 8/1975 | Tsao | 342/459 |
| 4,403,664 | 9/1983 | Sullinger | 175/24 |
| 4,646,277 | 2/1987 | Bridges et al. | 367/191 |
| 4,710,708 | 12/1987 | Rorden et al. | 324/207 |

*Primary Examiner*—Rolf Hille
*Assistant Examiner*—Michael C. Wimer
*Attorney, Agent, or Firm*—Flehr, Hohbach, Test, Albritton & Herbert

[57] ABSTRACT

The homing technique for directing an in-ground boring device through the ground from its particular location to a specific target point is disclosed herein. In accordance with this technique, an electromagnetic dipole field containing a predetermined homing signal is generated at the boring device and detected by a specifically configured receiving antenna arrangement at the target point or, in a preferred embodiment where the target point is below ground, at a ground level point directly above or beyond the target point. Means are provided in response to detection of the homing signal for producing an internal electrical signal containing certain information relating to the actual path taken by the boring device as compared to the path or course leading to the target point. The information from this latter signal is then transmitted by means of electromagnetic waves to a remote location where it is used to steer the boring device on a course toward the target.

17 Claims, 7 Drawing Sheets

HOMING TECHNIQUE FOR AN IN-GROUND BORING DEVICE

The present invention relates generally to a technique for controlling the movement of an in-ground boring device as the latter moves through the ground, and more particularly to a homing technique for directing an in-ground boring device through the ground from its particular location at a given point to a specific in-ground target point.

The present invention is specifically related to Baker et al. copending U.S. patent application Ser. Nos. 866,240, now U.S. Pat. No. 4,821,875, and 866,241, now U.S. Pat. No. 4,714,118, each of which was filed on May 22, 1986 and each of which is assigned to assignee of the present application. In the first of these two copending applications (hereinafter Baker I), which is incorporated herein by reference, a system for providing an underground tunnel utilizing a powered boring device is disclosed. The device itself is pushed through the ground by an attached umbilical which is driven from an aboveground thrust assembly. In the second copending application (hereinafter Baker II), which is also incorporated herein by reference, a technique is described for steering and monitoring the orientation of the boring device as the latter travels through the ground. This includes techniques for monitoring the roll and pitch angles and in-ground depth of the boring device.

Neither of the copending patent applications just recited includes a technique for establishing the path for the boring device to take from a particular location in the ground, for example, from its starting point to one or more target points including, for example, its final destination. As will be seen hereinafter, the present invention provides for a homing technique to accomplish this, and particularly a homing technique which is uncomplicated and reliable, which preferably requires a relatively small amount of power, and which can be used with a relatively small transmitting antenna, for example, one on the order of 2.50 inches long and 0.50 inch in diameter.

The basic concept of guiding and controlling an in-ground boring device so as to cause it to home in on a target is not new, particularly in the drilling art. One such system generates a relatively powerful dipole field, on the order of one kilowatt of power, using an antenna which is relatively large, on the order of 5 feet long and 4–6 inches in diameter. A receiving arrangement including specifically a magnetometer is placed at the target point and used to detect the radiation pattern generated by the boring device in order to produce its own guidance signal. The receiving arrangement is hard-wired to a monitoring station for conducting the guidance signal thereto.

One disadvantage to the prior art system just described is that the boring device must be relatively large to accommodate the transmitting antenna for such a powerful electromagnetic field. Another disadvantage is that because the boring device generates such a relatively high powered electromagnetic field, it must be relatively large. Still another disadvantage of the system is that the target point for the boring device and the receiving arrangement for detecting the electromagnetic field must coincide. Therefore, if it is desirable to place the target point at a particular location below ground, the receiving arrangement must be placed at the same location. A further disadvantage and an especially important one is that the receiving arrangement and the monitoring station are hard-wired to one another, making it relatively difficult to relocate the receiving arrangement from one point to another in order to change the target point during operation of the overall system, should this be necessary or desirable.

In view of the foregoing, one object of the present invention is to provide a homing or guidance and control system for directing an in-ground boring device through the ground to a particular target point, and specifically a system which does not have the disadvantages discussed immediately above.

A more particular object of the present invention is to provide a homing system in which the target point can be selected to be below ground while the target antenna (e.g., receiving arrangement) can be located aboveground, and specifically a system in which its homing controls act only on the horizontal component of movement of the boring device while its vertical component of movement is independently controlled so that the target point and receiving arrangement do not have to coincide.

Still another particular object of the present invention is to provide a homing system including a target antenna which remains physically unconnected with any other components of the system so that it can be readily placed at different locations so as to readily change the target point for the boring device.

As will be described in more detail hereinafter, the guidance and control or homing system disclosed herein utilizes means including a transmitting antenna carried by its boring device for producing a near full electromagnetic dipole field containing a predetermined homing signal. A receiving assembly including a receiving antenna arrangement of specific configuration is located at a particular target point or, in a preferred embodiment where the target point is below ground, at a ground level location directly above (or possibly beyond) the target point. The receiving antenna serves to detect the homing signal and produce its own internal signal containing information which indicates whether the boring device is on or off a particular course leading to the target point and, if the boring device is off course, whether its horizontal component of movement is headed to the left or right of the course with respect to the target point. The assembly including the receiving antenna also includes a transmitting antenna which is responsive to the internal signal produced by one assembly for transmitting by electromagnetic waves a control signal containing the same information to a remote location, typically the starting point for the boring device. Cooperating guidance and control components located in part at this remote location and in part on the boring device responds, at least in part, to the transmitted control signal for steering the boring device on a course to the target point.

The overall system will be described in more detail below in conjunction with the drawings wherein:

FIG. 1 diagrammatically illustrates, in elevation, a guidance and control system designed in accordance with the present invention;

Figure 1:
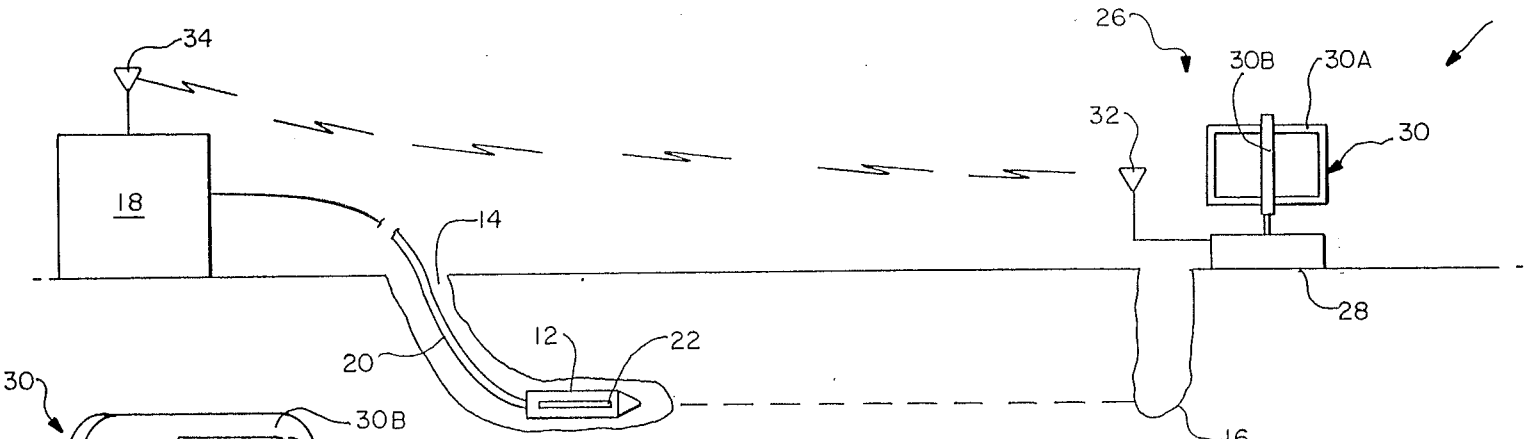
FIG. 1A is a vertical elevational view of a receiving antenna forming part of the system illustrated in FIG. 1.
Figure 4A:
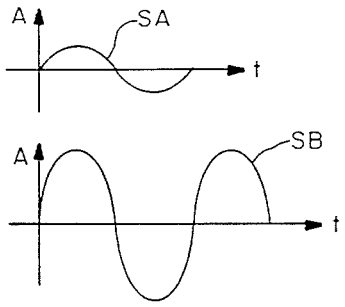
Figure 4B:
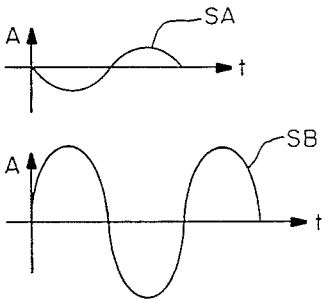
Figure 5:
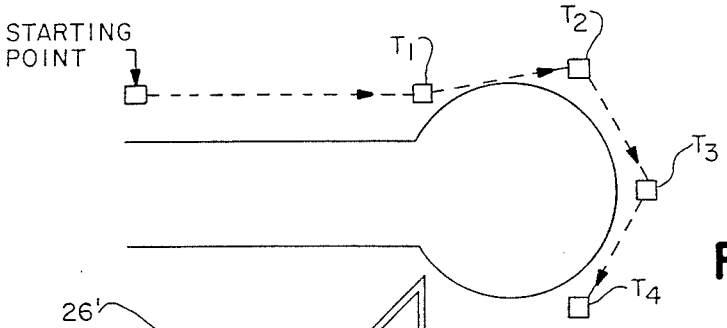
Figure 8:
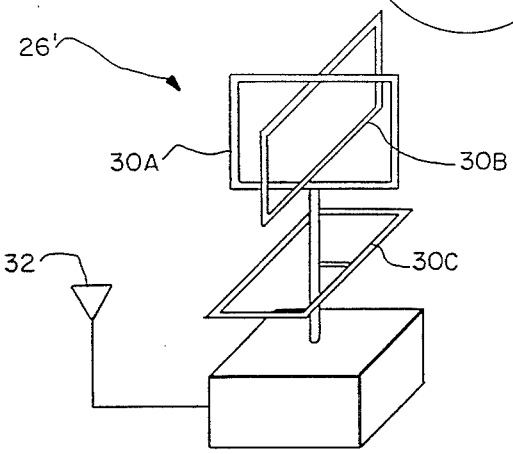
Figure 6:
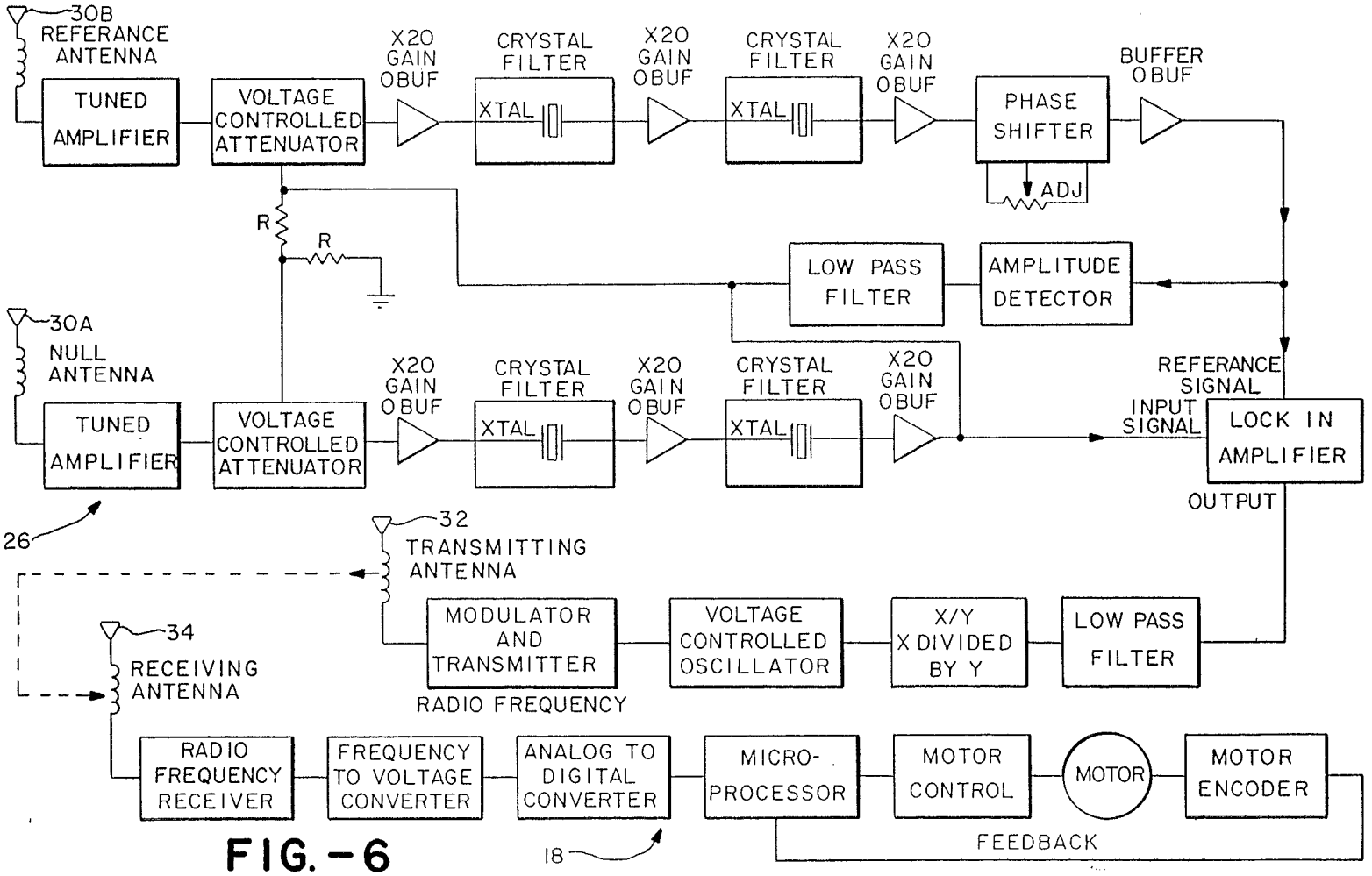
Figure 7A:
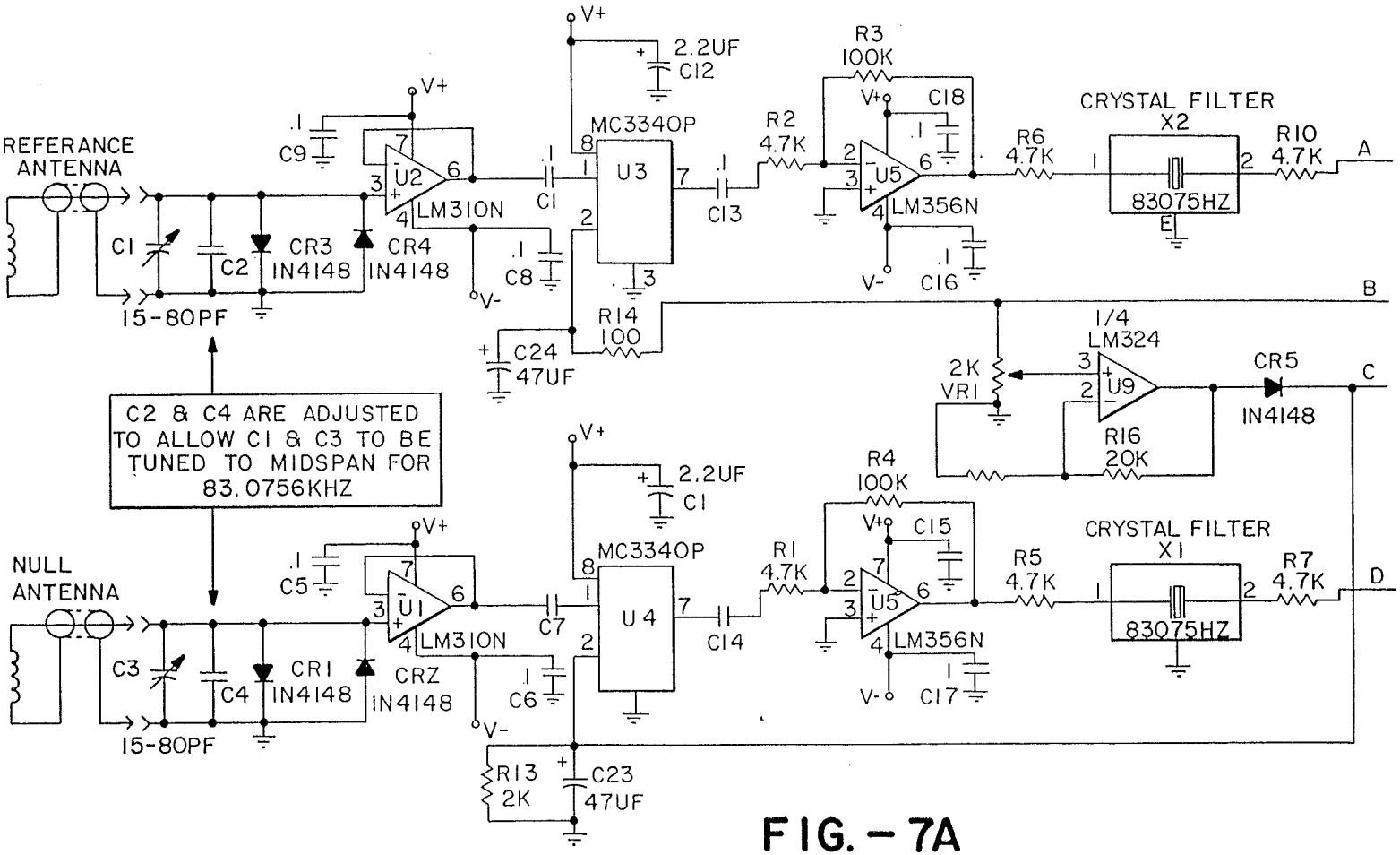
Figure 7B:
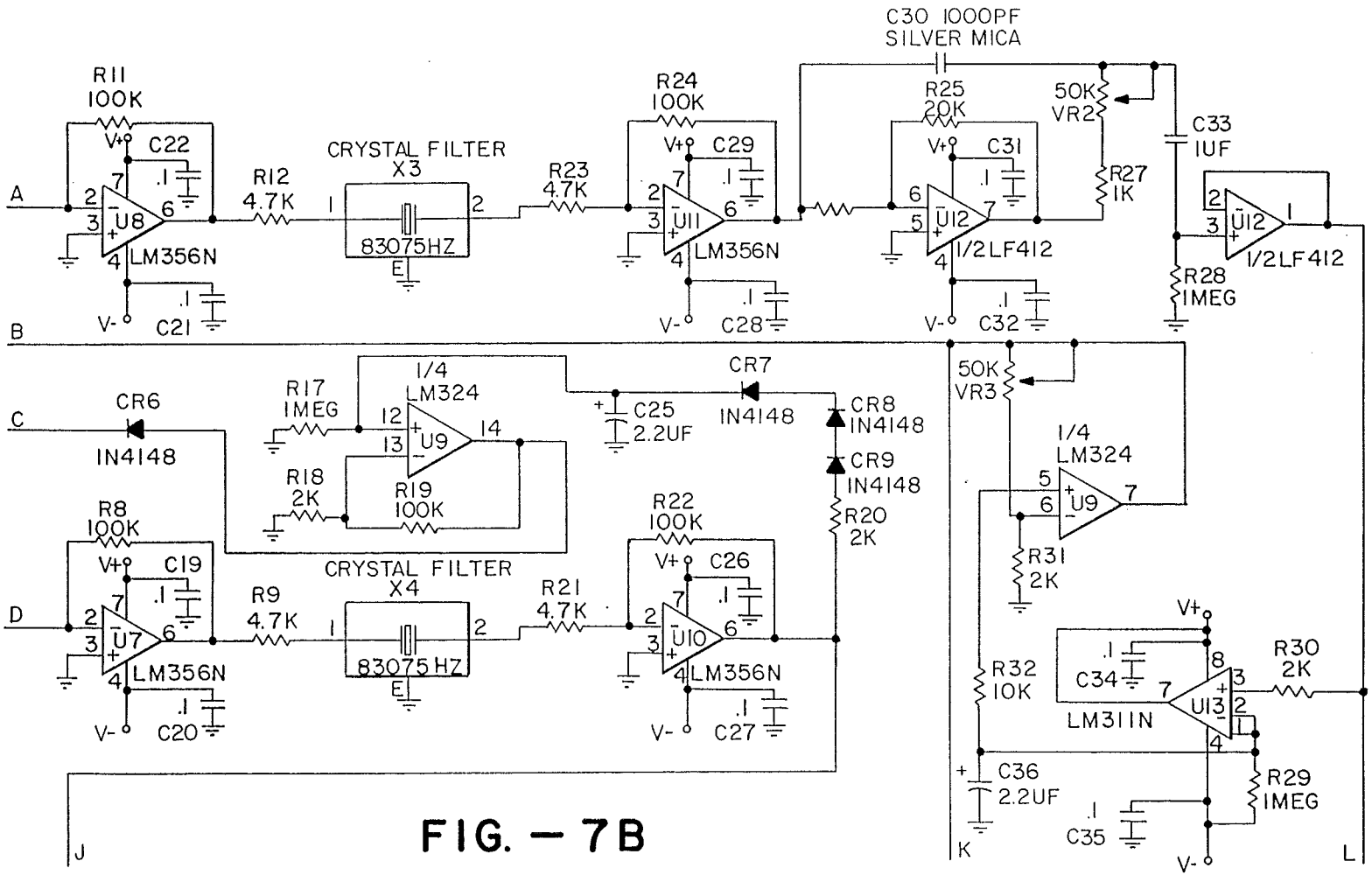
Figure 7C:
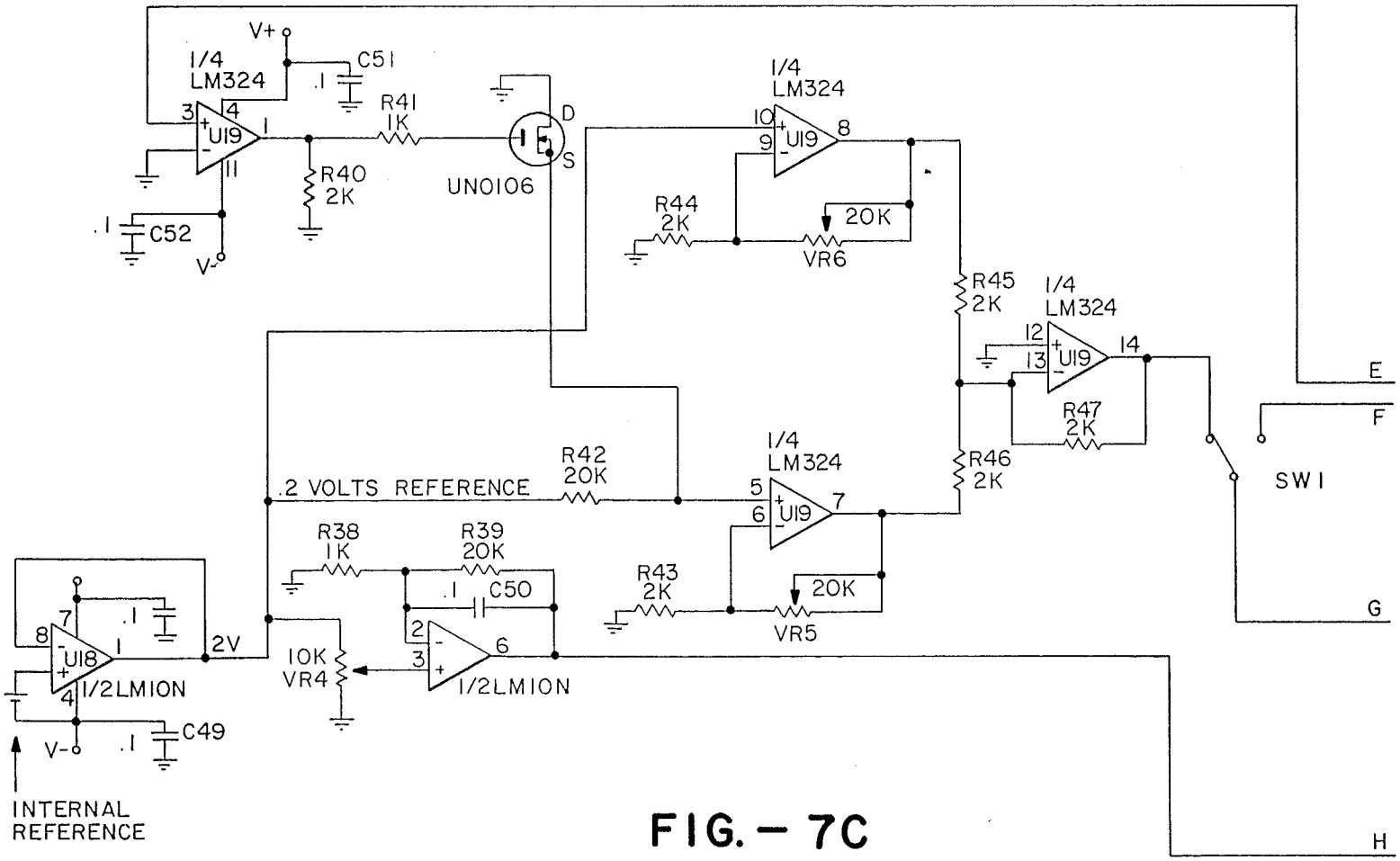
Figure 7D:
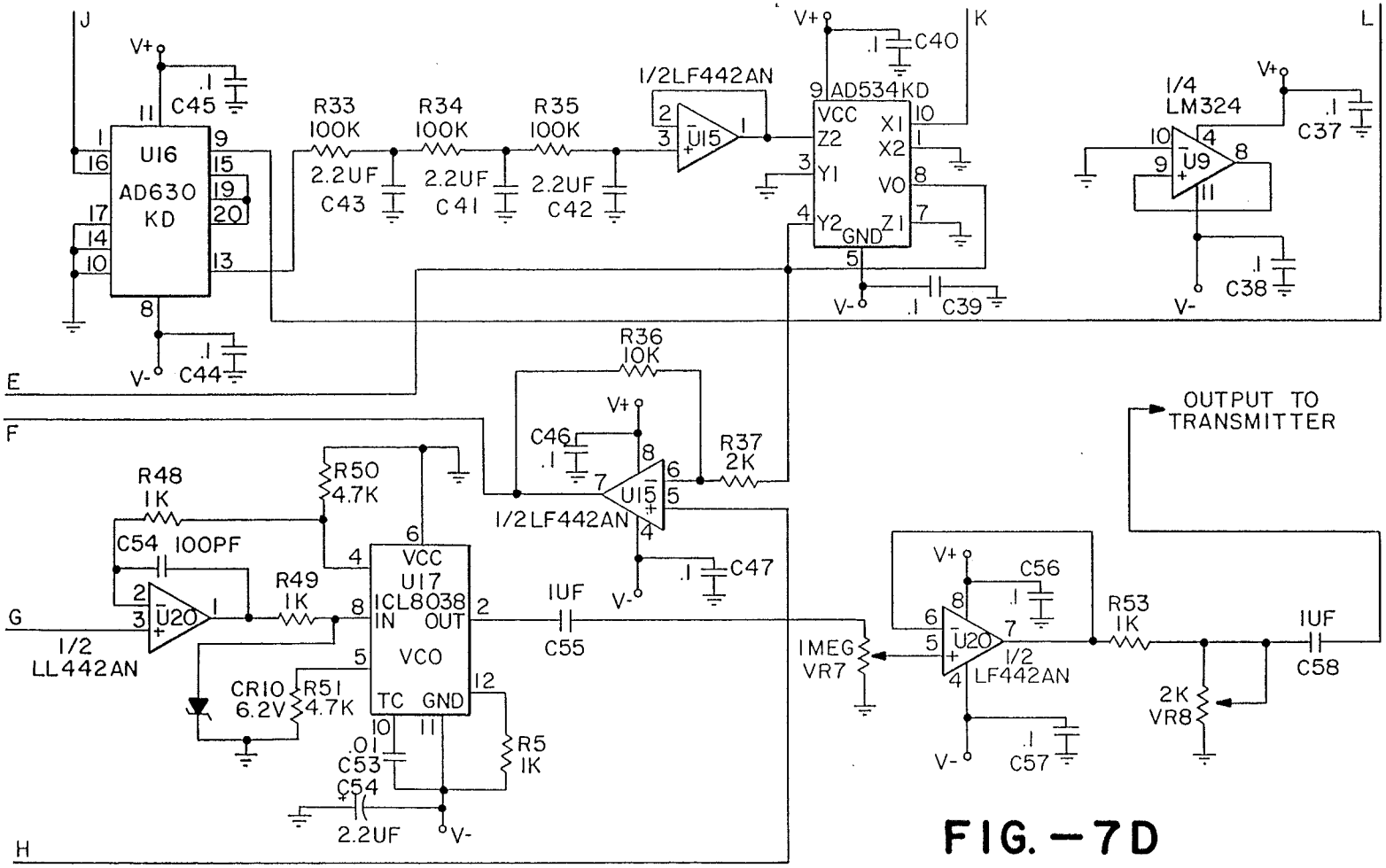

FIGS. 4*a* and 4*b* are graphic illustrations of the way in which the system of FIG. 1 operates;

FIG. 5 diagrammatically illustrates, in plan view, the way in which the system of FIG. 1 can be used to cause its boring device to home in on a number of different target points in order to provide a specifically configured boring path;

FIG. 6 is an electronic block diagram depicting the electronic controls or the homing system of FIG. 1;

FIGS. 7*a–d* are detailed schematic illustrations corresponding to the block diagram of FIG. 6; and FIG. 8 is a diagrammatic illustration, in perspective view, of a modified receiving arrangement which could form part of a second embodiment of an overall guidance and control system designed in accordance with the present invention.

Turning now to the drawings, FIG. 1 illustrates a guidance and control or homing system designed in accordance with the present invention and generally indicated by the reference numeral 10. This system includes a boring device 12 and an assembly of other components which serve to physically move and guide the boring device through the ground from an aboveground starting point 14 to the particular in-ground target point 16 which might or might not be its final destination. These other components include a control station 18 at starting point 14 and an umbilical arrangement 20 which serves to connect the boring device to the control station for physically moving the boring device as the latter steers through the ground under the control of the control station, as will be described in more detail below.

The boring device itself carries suitable means generally indicated at 22 for producing a near full electromagnetic dipole field 24 (FIG. 2) containing a precontrolled homing signal. A receiving assembly which is generally indicated at 26 and which also forms part of the overall homing system is located at ground level location 28 directly above or beyond target point 16. This assembly includes a specifically configured receiving antenna 30 which serves to detect the homing signal contained within dipole field 24. Other components forming part of overall assembly 26 respond to the detection of this homing signal to produce an internal electronic signal containing information which indicates whether the boring device is on or off a particular course line leading to target point 16 and, if the boring device is off its course, whether its horizontal component of movement is headed to the left or right of the course line with respect to the target point. A transmitting assembly 32, also forming part of assembly 26, responds to this internal signal for transmitting by means of electromagnetic waves a control signal containing the same information back to control station 18 where it is picked up by a cooperating receiving antenna 34. Components located in part at control station 18 and in part on boring device 12 respond to the transmitted control signal in order to control the horizontal component of movement of the boring device as it is steered on course to target point 16. The control station includes its own means apart from the control signal for controlling the vertical component of movement of the boring device, as the latter moves to target point 16.

The present invention, as embodied in system 10, is directed to a particular way in which the horizontal component of movement of boring device 12 is controlled to cause the boring device to home in on target point 16 as the boring device moves through the ground. The particular way in which the vertical component of movement of the boring device is controlled does not form part of the present invention, as indicated immediately above, except in combination with the horizontal component. Moreover, it is to be understood that the boring device itself, except for its onboard dipole field generating arrangement, does not form part of the present invention, nor the way in which the boring device is physically thrust through the ground. These latter features are described in detail in the previously recited Baker I and Baker II copending applications, as will be discussed in more detail directly below.

In Baker I, the boring device there is shown including a series of high pressure fluid jets at its front end for boring through the soil. It is connected at its back end to a continuous umbilical. The latter is acted upon by a thrust assembly to physically push the boring device through the soil as its fluid jets cut a path in front of it. All of the physical aspects of the boring device itself and the way in which it is thrust through the soil, as described in Baker I, may be incorporated into boring device 12 and control station 18.

In Baker II, the same physical boring device and thrust assembly are illustrated along with a specific technique for steering the boring device through the ground and monitoring its orientation. More specifically, in Baker II, there is described a particular technique for physically steering the boring device by rotating its forward fluid jets in a modulated fashion and there are specific arrangements illustrated for monitoring the boring device's pitch and roll angles relative to given references. At the same time, Baker II indicates that the depth of the boring device, that is, its vertical distance with respect to, for example, ground level, can be monitored by a conventional arrangement. One such arrangement includes a tube having one end which contains a pressure transducer while the opposite end is maintained in fluid communication with a reservoir filled with, for example, hydraulic fluid which also fills the tube itself. The end of the tube containing the pressure transducer is located in the boring device and the reservoir is placed at ground level with the tube running through the umbilical. In this way, the head pressure at the transducer resulting from the hydraulic fluid varies linearly with the vertical position of the boring device and therefore can be conventionally and suitably monitored, once calibrated, to monitor the depth of the boring device.

The way in which the boring device in Baker II is physically steered, the particular ways in which its pitch and roll angles are monitored, and the specific technique for monitoring its depth in the ground, as described immediately above, are incorporated herein by reference. At the same time, it is to be understood that the present invention is not limited to these particular techniques. Other suitable means may be provided for specifically steering the boring device and for monitoring its pitch and roll angles and its depth within the ground. At the same time, it is to be understood that the physical and electronic controls forming part of control station 18 and the boring device itself for controlling the vertical component of movement of the device in system 10 does not per se form part of the present invention. The vertical component of movement of the boring device can be controlled manually by an operator or it can be preprogrammed by means of a computer. For example, where the aboveground contour between starting point 14 and target point 16 defines a hill, the vertical component of movement of device 12 can be preprogrammed so that it parallels the curvature of the aboveground contour as it moves from its starting point to its target point. Where it is necessary to physically follow the actual location of the boring device at any given time, this can be accomplished by utilizing, for example, a locating arrangement of the type described in copending patent application Ser. No. 866,242 which was filed on May 22, 1986. That application which was assigned to assignee of the present application is also incorporated herein by reference.

In view of the foregoing, it should be apparent that the present invention, as embodied in system 10, does not reside in the physical way in which boring device 12 moves up or down or to the left or right or to the way in which control station 18 acts on the boring device to cause it to move in any of these directions. Moreover, the invention embodied in system 10 does not reside in the way in which the system establishes its criteria for controlling the vertical component of movement of the boring device. Rather, the present invention embodied in system 10 resides in the particular way in which the horizontal component of movement of the boring device is established as it moves through the round in order to cause it to home in on target point 16. This will be described below in conjunction with FIGS. 2, 3 and 4*a*, 4*b*.

Figure 1A:
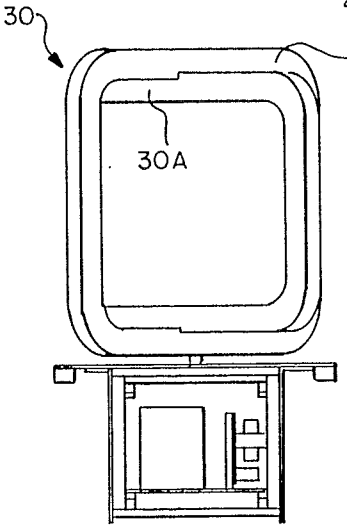

As indicated above, receiving arrangement 26 includes a specifically configured antenna arrangement 30. This arrangement includes a pair of conventional and readily providable looped antennas 30*a* and 30*b* which are preferably placed in intersecting perpendicular planes but electrically insulated from one another. Each of these looped antennas is intended to receive only the magnetic component of dipole field 24 and therefore includes a conventional and readily providable shield for blocking out the electric component of the field. An actual working embodiment of one of these looped antennas is illustrated in FIG. 1*a*. Note that this antenna includes about 100 turns of Litz wire and the outside of the loop is shielded by suitable metal. A small gap is provided on the shield such that the shield does not form a continuous loop.

As stated above, the electromagnetic dipole field 24 generated from boring device 12 includes a predetermined homing signal. This signal uses the amplitude of the field of a fixed frequency, of about 2 to 3 Khz to as high as about 0.5 Mhz, preferably a frequency of between about 80 and 90 KHz and specifically 83.075 KHz in an actual working embodiment. Each of the looped antennas 30*a* and 30*b* is designed to pick up on the components of field 24 (e.g., the homing signal) that is normal to the plane of its loop, and only those components, as is known in the art. This results in a pick up signal having the same frequency as the homing signal and an amplitude which depends upon the intensity of normal component of the field so picked up.

Figure 2:
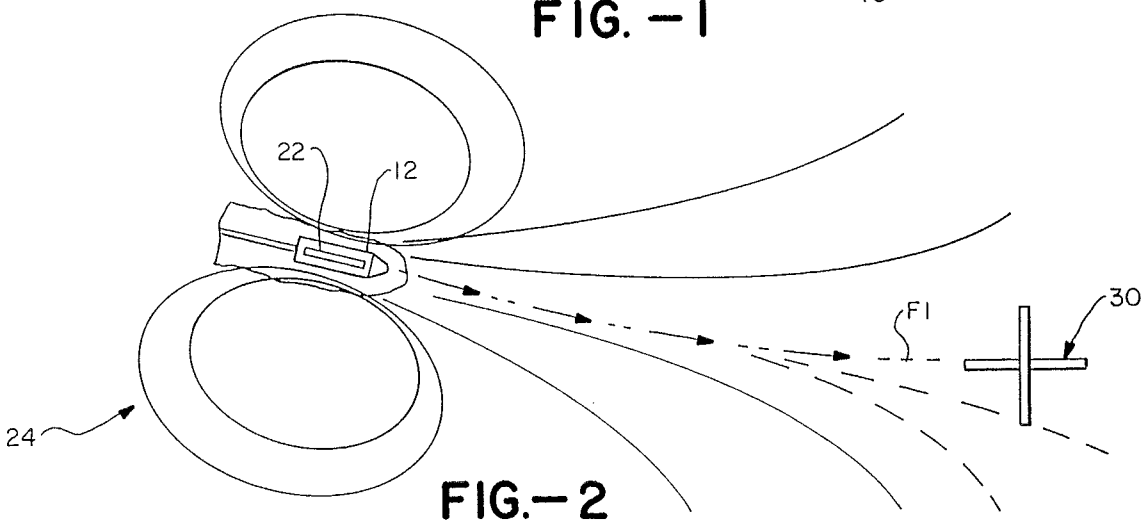
FIGS. 2 and 3 are diagrammatic illustrations, in plan view, of the way in which the system of FIG. 1 operates.

Referring specifically to FIG. 2 in conjunction with FIGS. 1 and 4*a*, 4*b*, the antenna 30*a* is shown in FIGS. 1 and 2 in line with the desired course of device 12 at a given point in time as the latter moves through the ground. At the same time, antenna 30*b* extends normal to that designed course. Antenna 30*a* is intended to establish the course line and, as will be seen, serves as a null antenna, while antenna 30*b* is intended to serve as a reference antenna. Because reference antenna 30*b* extends normal to the intended course of boring device 12 and therefore generally across the flux lines generated by its dipole field 24, antenna 30*b* produces a relatively strong (large amplitude) signal SB (FIGS. 4*a*, 4*b*) having the same frequency as the homing signal. As will be seen below, this signal is processed by circuitry forming part of overall receiver assembly 26, preferably including circuit means to maintain the amplitude of signal SB at a constant, readily detectable level whether boring device 12 is on course or slightly off course and regardless of its nearness to antennas 30*a*, 30*b*.

Because the null antenna 30*a* is positioned parallel to the intended course of boring device 12, when the boring device is precisely on course, there are substantially no flux lines making up field 24 which cut through the null antenna and, absent even a horizontal component cutting through the null antenna, the latter does not generate a signal at all. However, as the boring device moves from its intended path, as established by the position of null antenna 30*a*, the normal component of the particular flux line will instantaneously cut through the null antenna and produce a relatively low amplitude signal SA as illustrated in FIGS. 4*a* and 4*b*, at the same frequency as the homing signal and therefore at the same frequency as signal SB. It should be noted from FIGS. 4*a* and 4*b* that the amplitude of signal SA, relatively speaking, is substantially smaller than the amplitude of signal SB. That is because the flux lines from boring device 12 cut through the null antenna, if they cut through at all, at a much greater angle (with respect to its normal) than they cut through the reference antenna.

Still referring to FIGS. 4*a* and 4*b* in conjunction with FIG. 2, as stated immediately above, if boring device 12 is on course, no null signal SA will be produced at all, that is, its amplitude will be zero. If the boring device starts to move horizontally to the left or to the right of its course line (e.g., its horizontal component), it will result in the immediate production of signal SA. If the deviation is to the left of the course line, the flux lines from dipole field 24 will cut through null antenna 30*a* in one direction and if the deviation is to the right, it will cut through the antenna in the opposite direction. As a result, the corresponding null signals SA will be 180° out of phase with one another. FIG. 4*a* shows a deviation signal to the left, for example, while FIG. 4*b* illustrates a deviation signal in the opposite direction, for example to the right. Note that a given point in time on the reference signal SB, for example, at its peak positive amplitude, the null signal SA in FIG. 4*a* is positive with respect to the reference signal while the signal SA in FIG. 4*b* is negative with respect to the same point in the reference signal. In this way, the reference signal can be used in conjunction with, for example, an oscilloscope, to determine whether a particular deviation in the path taken by boring device 12 is to the left or right of the intended course.

Figure 3:
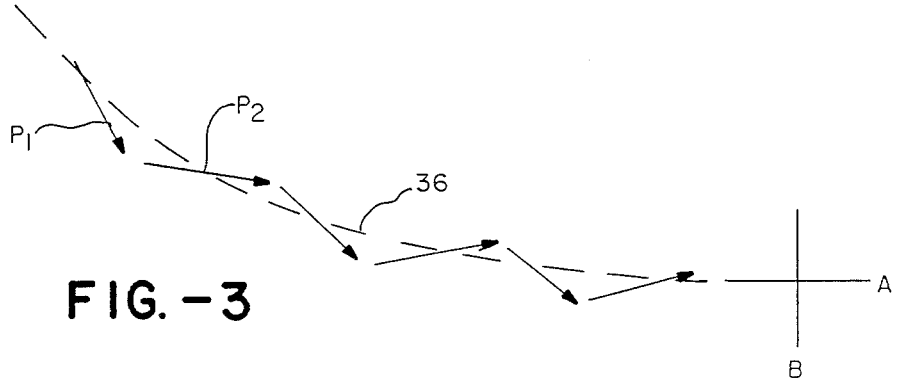

The processing circuitry forming part of overall assembly 26 processes both the reference signal and null signal (if present) and produces its own processed internal signal which indicates whether the boring device is on or off a particular course leading to the target point at that particular point in time and, if the boring device is off course, whether its horizontal component of movement is headed to the left or right of the course with respect to the target. This signal is then transmitted via antenna 32 to receiving antenna 34 where it is picked up and used by the control station 18 to control the movement of boring device 12 in order to eliminate the null signal all together, that is, to place the boring device back on its course. Thus, as shown in FIG. 3, if the boring device begins to move off to the right from its intended course $P_1$ (position 1) which is generally indicated by dotted lines at 36, the null signal SA (for example the one in FIG. 4*b*) will be generated, causing the boring device to be steered back to the left $P_2$ (position 2). This, in turn, will eliminate the null signal corresponding to FIG. 4*b* but might result in the boring device moving through the course line too far to the left, thereby producing the null signal SA shown in FIG. 4*a*. Thus, in actuality, the boring device will tend to zigzag its way to the target, as shown in an exaggerated manner in FIG. 3 as it moves from position 1 to position 2 and so on. In theory, boring device 12 locks on a single flux line, for example, the flux line F1 shown in FIG. 2, which is established by the position of null antenna 30*a*. So long as the boring device is not caused to move substantially from its intended course which might otherwise result from, for example, an obstruction, it will home in on flux line F1. Should it have to move substantially from flux line F1 due to an obstruction, it will eventually lock onto a different flux line and will move to the target in the same manner.

It is to be understood that the way in which boring device 12 locks in on a flux line and homes in on its target, as described above, relates only to its horizontal component of movement. Signals SA and SB only control whether the boring device moves to its left or to its right in a horizontal plane and not up and down. As a result, the boring device can be homed in on an in-ground target point, for example, point 16 without having to locate antennas 30*a* and 30*b* at the target point. The antennas could be located aboveground as illustrated in, for example, FIG. 1. At the same time, the vertical component of movement of the boring device can be simultaneously controlled by means of control station 30, either manually or through some sort of preset program through readily providable means not shown.

In order to carry out the homing procedure just described, it is only necessary to know that a null signal exists and its phase relative to the reference signal. With this information, the signal can be nulled out in the manner described above in order to maintain the boring device on course. However, it may be desirable to know how far off course in terms of heading and displacement the boring device is quantitatively. This can be determined from the same signals SA and SB. Since the amplitude of reference signal SB varies with distance ($1/r^3$, where r is the distance from the center of field 24), the amplitude of signal SA can be readily normalized with respect to the amplitude of the reference signal in order to determine course error magnitude quantitatively. The actual circuitry involved to accomplish this forms part of the overall circuitry forming part of receiving assembly 26, as will be discusses in conjunction with FIGS. 6 and 7.

Before turning to FIGS. 6 and 7, attention is briefly directed to FIG. 5. This figure diagrammatically illustrates the way in the system 10 can be used to move the boring device 12 along a series of paths around possible obstructions in a relatively uncomplicated manner. FIG. 5 diagrammatically illustrates a cul-de-sac. The boring device is initially directed into the ground at a starting point on one side of the cul-de-sac and the receiving assembly 26 is placed aboveground at a first point T1. Using system 10, the boring device is moved to a target point directly under T1. Thereafter, the receiving assembly is physically picked up and moved to a point T2 which is relatively easy since there are no hard wires associated with the receiving assembly and since the receiving assembly does not have to be buried. The boring device is then moved to the target point directly under T2. This procedure continues in order to move the boring device to T3 and finally to point T4.

Having described overall system 10, attention is now directed to FIG. 6 which is an electronic block diagram of assembly 26 including looped antennas 30*a* and 30*b*, transmitting antenna 32 and the electronic circuitry discussed above. FIG. 6 also depicts by means of block diagram the receiving antenna 34 and control circuitry forming part of control station 18 and part of the boring device, although the latter components do not per se form part of the present invention.

As illustrated in FIG. 6, the signal depicted by reference antenna 30*b* passes through a tuned amplifier which serves to reduce noise and increase its amplitude. This signal is passed through a voltage controlled attenuator which forms part of an overall feedback loop including an amplitude detector and low-pass filter, all of which function as an automatic gain control to fix the amplitude of signal SB, as discussed previously. The signal passes out of the voltage controlled attenuator and through a series of crystal filters which serve to narrow its bandwidth in order to increase its signal-to-noise ratio. An adjustable phase shifter acts on the signal to adjust for any imperfections in the antenna, e.g., for purposes of calibration, and then the signal is passed through a buffer and ultimately into a lock-in amplifier, as well as back through the feedback loop including the low-pass filter and amplitude detector.

At the same time, the null signal SA, assuming that one is present, passes through a similar tuned amplifier for reducing noise and increasing amplitude and thereafter through a voltage controlled amplifier and a series of crystal filters and thereafter into the lock-in amplifier. This latter component serves as a conventional synchronous detector so as to distinguish the relatively low amplitude null signal SA from noise by comparing it to the reference signal SB. At the same time, it serves to detect the phase of the null signal with respect to the reference signal and therefore whether the boring device has deviated to the left or right of its intended course. The output from the lock-in amplifier (which serves as the previously described internal signal) passes through a low-pass filter in order to reduce the bandwidth and eventually acts on a voltage controlled oscillator and modulator/transmitter for producing the previously described electromagnetic signal out of antenna 32. As it may be desirable to normalize the null signal with respect to the reference signal in order to provide a quantitative value for the null signal, the signal from the output of the lock-in amplifier, after passing through the low-pass filter, is input through the normalizing network (the x divided y box) as shown in FIG. 6.

The actual working circuitry associated with assembly 26 is illustrated in FIGS. 7*a–d* and is readily understandable by those of ordinary skill in the art in view of the foregoing and in view of the block diagram of FIG. 6 and, hence, will not be discussed herein.

Overall receiving assembly 26 has been described as including a specifically configured antenna arrangement 30 including two looped antennas 30*a* and 30*b*. In this way, the homing process for overall system 10 relates only to the horizontal components of movement of boring device 12. In FIG. 8, a modified receiving assembly 26' is illustrated. This assembly includes all of the same components forming part of assembly 26, that is, antennas 30a and 30b and transmitting antenna 32 as well as the associated circuitry. In addition, assembly 26' includes a second looped null antenna 30c which may be identical to antennas 30a and 30b but which is positioned orthogonal to both. Moreover, this third antenna includes associated circuitry which functions therewith in the same manner as the circuitry associated with antenna 30a, except that antenna 30c is responsible for controlling vertical deviations in the movement of the boring device from its intended path. In this way, the homing process controls both the horizontal and vertical components of movement of the boring device as it moves towards its intended target. This has the advantage that separate means for controlling the vertical component of movement of the boring device are not necessary. However, it does mean that the overall antenna configuration must coincide with the intended target point. That is, the boring device will home in on the antenna configuration itself wherever it is located.

What is claimed is:

1. A homing system including an in-ground boring device for directing said device through the ground from its particular location at a given point to a specific in-ground target point, said system comprising:

(a) first means including a transmitting antenna carried by said boring device for producing a near full electromagnetic dipole field which functions as a predetermined homing signal;

(b) second means including a receiving antenna arrangement and cooperating circuitry located at a ground level point for detecting said homing signal and for producing its own internal signal containing information which indicates whether the horizontal component of movement of the boring device is on or off a course leading to said target point and, if the boring device is off said course, whether its horizontal component of movement is headed to the left or right of some course which will bring the boring device to the target point;

(c) third means including a second transmitting antenna and cooperating circuitry also located at said ground level point and responsive to said internal signal for producing a control signal containing said information and transmitting said control signal by electromagnetic waves to a remote location; and (d) control means located in part at said remote location and in part on said boring device and at least in part responsive to said control signal for steering said device on a course to said target point.

2. A system according to claim 1 wherein said receiving antenna arrangement includes a first looped null antenna and a second looped reference antenna, wherein said second means establishes the horizontal component of the course to be taken by the boring device, and wherein said second means produces said internal signal so that the latter includes a reference component and, if the boring device is off course, a null component which when compared to the reference component indicates whether the boring device is heated to the left or right of said course.

3. A system according to claim 2 wherein said null and reference antennas are located in planes normal to one another.

4. A system according to claim 3 wherein said homing signal includes both magnetic and electric components and wherein said null and reference antennas include means for detecting only the magnetic components of said homing signal.

5. A system according to claim 4 wherein said first means includes circuitry cooperating with said transmitting antenna for producing said electromagnetic dipole field at no more than about one watt of power.

6. A system according to claim 5 wherein said homing signal displays a frequency of between about 80 and 90 KHz.

7. A system according to claim 5 wherein said boring device is between 6 and 12 inches long and at most about 3 inches wide.

8. A system according to claim 1 wherein said third means produces said control signal such that the latter establishes the horizontal component of movement of said boring device as it is steered to said target point by said control means and wherein said system includes means apart from said control signal for establishing the vertical component of movement of said device as the latter moves to said target point.

9. A system according to claim 1 wherein said second means produces said internal signal so that the information contained in said internal signal indicates not only whether the boring device is on or off a course leading to said target point but also the magnitude by which it is off course, if at all.

10. A system according to claim 2 wherein said homing signal has a certain frequency, wherein the reference component of said internal signal and its null component, if present, have said frequency and are always either in phase with one another or 180° out of phase, and wherein said cooperating circuitry of said second means includes means for comparing said null component with said reference component in order to distinguish said null component from any accompanying noise.

11. A system according to claim 10 wherein said reference component signal is substantially larger than said null component signal.

12. A system according to claim 11 wherein said comparing means includes means functioning as a synchronous detector.

13. A method of directing an in-ground boring device through the ground from its particular location at a given point to a specific in-ground target point, said method comprising the steps of:

(a) generating from said boring device a near full electromagnetic dipole field which functions as a predetermined homing signal;

(b) at a ground level location, detecting said homing signal by means of a receiving antenna arrangement and producing an internal signal containing information which indicates whether the horizontal component of movement of the boring device is on or off a course leading to said target point and, if the boring device is off said course, whether its horizontal component of movement is headed to the left or right of some course which will bring the boring device to the target point;

(c) in response to said internal signal, producing at said ground level point a control signal containing said information and transmitting said control signal by electromagnetic waves to a remote location; and (d) responding to said control signal at said remote location for steering said boring device on a course to said target point.

14. The method according to claim 13 wherein said electromagnetic dipole field is generated at no more than about one watt of power.

15. The method according to claim 14 wherein said homing signal displays a frequency of between about 80 and 90 KHz.

16. A homing device including a boring device for directing the boring device through the ground to a specific target point, comprising:

(a) first means carried by said boring device and including a transmitting antenna for generating an electromagnetic field which functions as a homing signal having a certain frequency;

(b) second means including a receiving antenna and cooperating circuitry for detecting said homing signal and for producing its own internal signal containing certain information about the position of said boring device relative to said specific target point, said internal signal always including a reference component and sometimes a null component depending upon the positional relationship between said boring device and said target, which null component is substantially smaller in amplitude than said reference component, said cooperating circuitry including means for comparing said null component with said reference component in order to distinguish said null component from any accompanying noise;

(c) third means cooperating with said second means so as to receive said internal signal for steering said boring device toward said target point based upon said certain information contained by said internal signal; and (d) said target point being underground and said second means being above ground, said second means including means for producing and transmitting by means of telemetry to said third means a control signal in response to and dependent on said internal signal, and said third means including a receiving antenna for receiving said control signal for directing said boring device toward said target point in response to said control signal.

17. A system according to claim 16 wherein said reference and null components have said frequency and wherein said comparing means includes means functioning as a synchronous detector.

* * * * *